United States Patent [19]

Mahler

[11] Patent Number: 4,616,759

[45] Date of Patent: Oct. 14, 1986

[54] LIQUID-DISPENSING CONTAINER ASSEMBLY

[76] Inventor: Darrell Mahler, 2600 Hodgson Cir., Topanga, Calif. 90290

[21] Appl. No.: 796,167

[22] Filed: Nov. 8, 1985

[51] Int. Cl.[4] ..... B65D 51/24

[52] U.S. Cl. ..... 215/228; 141/381; 215/329; 215/321; 215/352

[58] Field of Search ..... 215/329, 228, 321, 344, 215/352; 141/381

[56] References Cited

U.S. PATENT DOCUMENTS

| | | | |
|---|---|---|---|
| 2,014,093 | 9/1935 | Terrill | 215/329 X |
| 3,159,298 | 12/1964 | Saw | 215/228 |
| 3,804,282 | 4/1974 | Komendowski | 215/228 X |
| 3,857,509 | 12/1974 | Baldwin et al. | 215/329 |
| 4,566,508 | 1/1986 | Bowyer | 215/228 X |

*Primary Examiner*—Donald F. Norton
*Attorney, Agent, or Firm*—John J. Posta, Jr.

[57] ABSTRACT

The measuring cap-containing, liquid-dispensing container assembly includes a container with interior storage space and upstanding pour spout connected to the space, an annular raised platform peripheral of the spout base and an annular recessed liquid drainage channel between the spout base and platform. The channel preferably has a curved bottom and has a drainage hole communicating with the container storage space. The assembly includes a measuring cap disposed over and releasably secured to the spout by a first seal. The base of the cap abuts the platform and is sealed thereto by a second seal. The first seal can be an annular sleeve depending from the cap top interior peripheral of the spout, and mating threads or mating detents and recesses on the spout exterior and sleeve interior. The second seal is an o-ring in a recess in the cap base and/or platform, or a detent in one of the cap base or platform and a mating recess in the other of the cap base and platform. Thus, the container is self-draining and double sealed for optional liquid measuring, dispensing and storage.

9 Claims, 11 Drawing Figures

LIQUID-DISPENSING CONTAINER ASSEMBLY

BACKGROUND OF THE INVENTION

1. Field of the Invention

The present invention generally relates to containers and, more particularly, to double-sealed, self-draining, liquid-dispensing container assemblies.

2. Prior Art

The usual type of household liquid soap, bleach or detergent container, or similar liquid-dispensing container has a screw cap. When liquid is to be dispensed, it usually is measured into a separate measuring cup provided by the user.

Certain of such containers include a measuring cup as the container cap. However, when the cup is used, some of the liquid fails to immediately drain from it, so that when the cap is inverted to close the container, the liquid leaks from the cap and drains down the outside of the container, making a mess and causing a loss of usable liquid. Even when the cap is screwed tightly down over the container there still is a loss of liquid and a resulting mess, because the liquid is trapped outside the container on the container top under the cap.

Accordingly, there is a need for an improved measuring cap-containing, liquid-dispensing container assembly which will conserve liquid draining from the inverted cap and will not foul the exterior of the container.

SUMMARY OF THE INVENTION

The improved measuring cap-containing, liquid-dispensing container assembly of the present invention satisfies all the foregoing needs. The assembly is substantially as set forth in the Abstract. Thus, the assembly includes a hollow liquid storage container having an upstanding dispensing spout communicating with the liquid storage space in the container.

The top of the container includes a raised annular platform peripheral of the spout and an annular recessed liquid drainage channel between the spout and platform, and contains a bottom drainage hole communicating with the liquid storage space in the container. Preferably, the channel has a curved depending bottom to facilitate liquid drainage.

The assembly includes a measuring cap which is received over and releasably secured to the spout by a first seal, with the base of the cap sealed to the platform by a second seal. The first seal includes a central annular sleeve peripheral of the spout and depending from the cap top interior, and either mating threads or mating detents and recesses on the spout exterior and sleeve interior. The second seal comprises an o-ring disposed in a recess in and extending from the base of the cap or platform, or an annular detent integral with and extending from either the cap base or platform and receivable within a mating recess in the other of the cap base and platform.

For storage purposes, the double seal doubly protects the liquid in the container from evaporation and spillage. Moreover, when the measuring cap is used and then replaced in sealing engagement with the container, liquid thereafter draining from the inverted cap passes into the annular channel and back into the container interior storage space, so that the container exterior top and cap remain clean and free of liquid.

Various other features of the present invention are set forth in the following detailed description and accompanying drawings.

DRAWINGS

DETAILED DESCRIPTION

FIGS. 1–6

Figure 1:
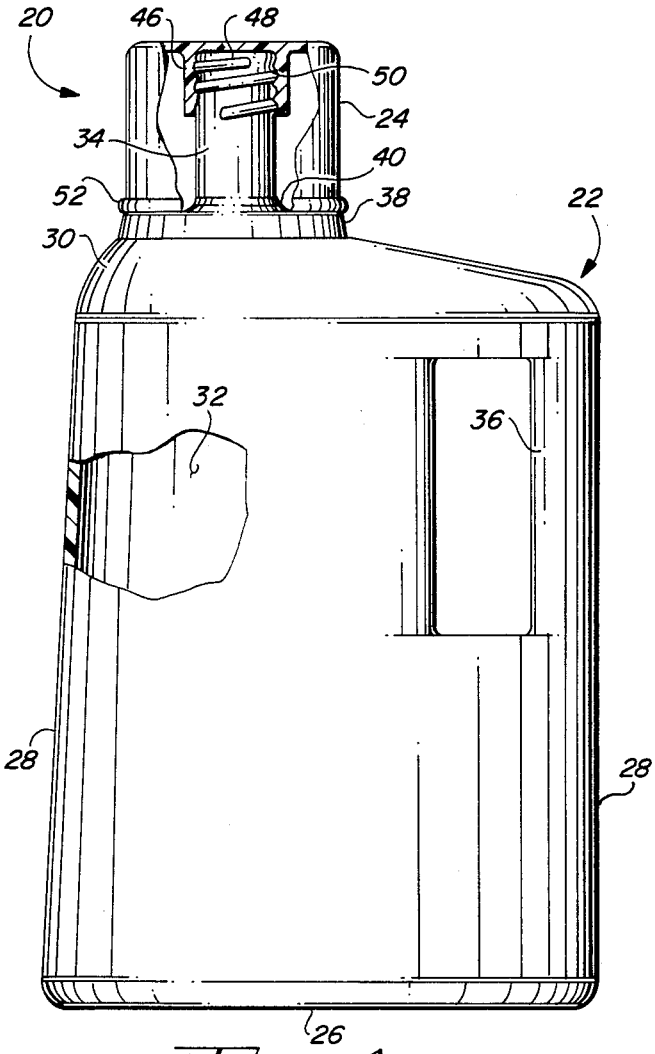
FIG. 1 is a schematic side elevation, partly broken away, of a first preferred embodiment of the improved measuring cap-containing, liquid-dispensing container assembly of the present invention.
Figure 3:
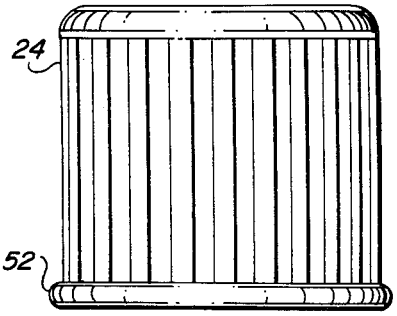
FIG. 3 is a schematic side elevation of the cap of the assembly of FIG. 1.
Figure 4:
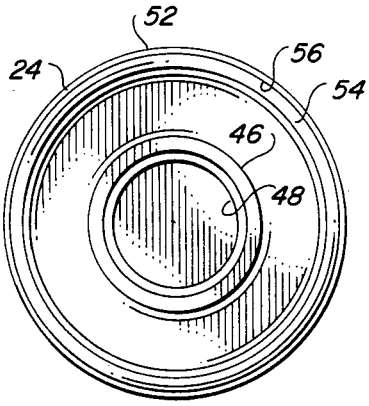
FIG. 4 is a schematic bottom plan view of the cap of FIG. 3.
Figure 5:
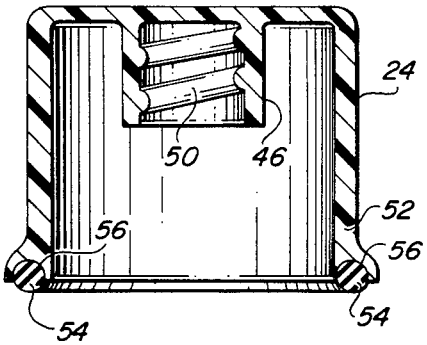
FIG. 5 is an enlarged schematic vertical section of the cap of FIG. 3.
Figure 2:
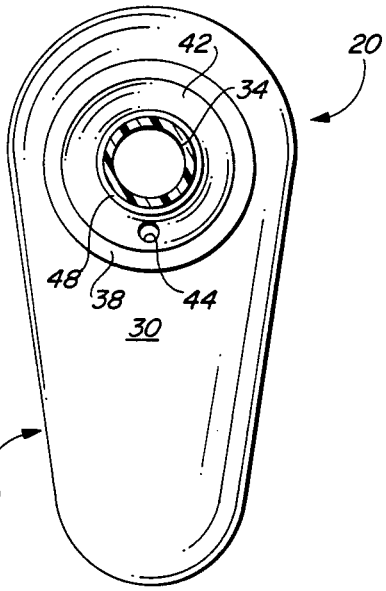
FIG. 2 is a schematic top plan view of the container of the assembly of FIG. 1.
Figure 6:
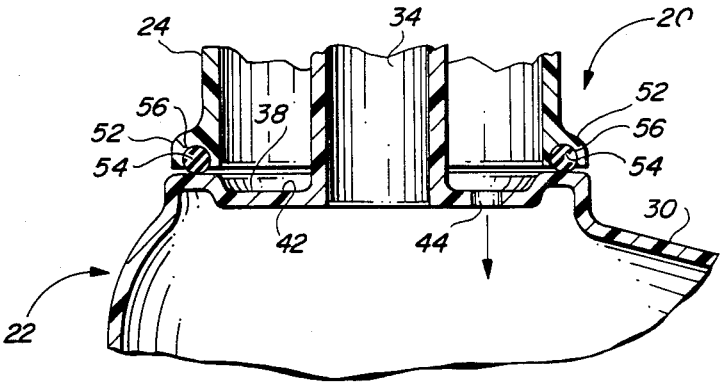
FIG. 6 is an enlarged schematic fragmentary vertical section of the base of the cap of FIG. 3 and the platform of the container of FIG. 1.

Now referring more particularly to FIGS. 1–6, a first preferred embodiment of the improved assembly of the present invention is schematically depicted therein. Thus, assembly 20 is shown which comprises a container 22 with dispensing cap 24. Container 22 has a flat bottom 26, interconnected sidewalls 28 and top 30 defining an interior liquid storage space 32 communicating with an upstanding generally cylindrical hollow pour spout 34 connected to top 30 (FIG. 1). Container 12 may include a hand grip 36 for ease of pouring liquid from space 32 through spout 34.

In the storage condition shown in FIG. 1, spout 34 is covered by cap 24 which is in the inverted position. Top 30 includes a raised annular platform 38 spaced peripheral of the base 40 of spout 34 and defining therebetween a recessed annular drainage channel 42 containing a bottom drain hole 44 communicating with space 32.

Cap 24 is disposed over and releasably secured to spout 34 by first sealing means comprising an integral annular sleeve 46 depending from the central interior portion of cap 24 (FIGS. 1 and 5) peripheral of spout 34, and mating threads 48 and 50 on, respectively, the exterior of spout 34 and interior of sleeve 46.

Thus, cap 24 can be threaded down via sleeve 46 over spout 34 until cap base 52 abuts platform 38 so that second sealing means provided herein take effect. Those sealing means comprise an o-ring 54 disposed in a recess 56 in cap base 52 and protruding downwardly therefrom towards platform 38. As cap base 52 is screwed tightly against platform 38 (FIGS. 1 & 6), o-ring 54 seals and flattens against platform 38, thus isolating channel 42 and platform 38 against liquid leakage outwardly therefrom as liquid in cap 24 drains down into channel 42 and through hole 44 into space 32 of container 12.

The double seal of the screw cap and o-ring prevent evaporation and leakage of liquid from assembly 10, while the configuration of platform 38, channel 42 and hole 44 along with cap 24 permit full drainage of liquid from cap 24 (after it has been used as a measuring cup) back into container 12.

It will be noted that assembly 10 can be easily fabricated of plastic, plastic coated cellulosic material, ceramic, wood, metal or the like. For most purposes, polyethylene or other easily moulded thermoplastic or thermosetting plastic material is preferred. Thus, assembly 10 is inexpensive, durable and efficient and can be made in a variety of sizes and shapes.

FIG. 7

Figure 7:
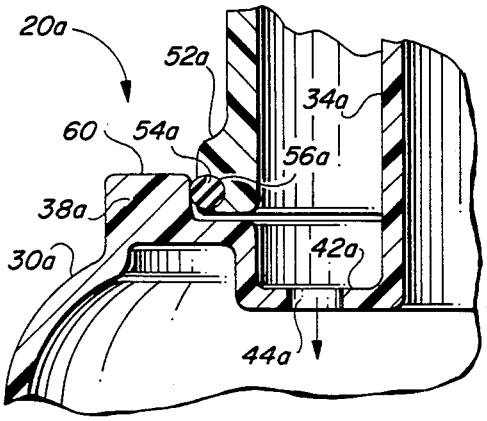
FIG. 7 is an enlarged schematic fragmentary vertical section of a portion of the cap base and platform of a second preferred embodiment of the assembly of the present invention.

Now referring more particularly to FIG. 7 of the drawings, a second preferred embodiment of the invention is schematically depicted therein. Thus, assembly 20*a* is shown. Components thereof similar to those of assembly 20 bear the same numerals but are succeeded by the letter "a". Assembly 20*a* is identical to assembly 20 except that o-ring 54*a* is in a recess 56*a* in the outer surface of base 52*a*. It contacts the adjacent specially configured raised outer periphery 60 of platform 38*a* to seal it off. Assembly 20*a* has substantially the advantages of assembly 20.

FIGS. 8, 9 & 10

Figure 8:
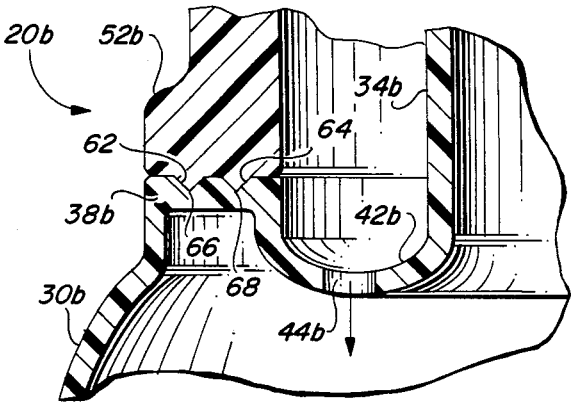
FIG. 8 is an enlarged schematic fragmentary vertical section of a portion of the cap base and platform of a third preferred embodiment of the assembly of the present invention.
Figure 9:
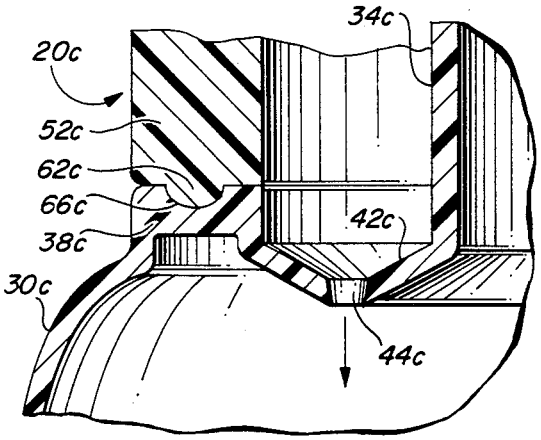
FIG. 9 is an enlarged schematic fragmentary vertical section of a portion of the cap base and platform of a fourth preferred embodiment of the assembly of the present invention.
Figure 10:
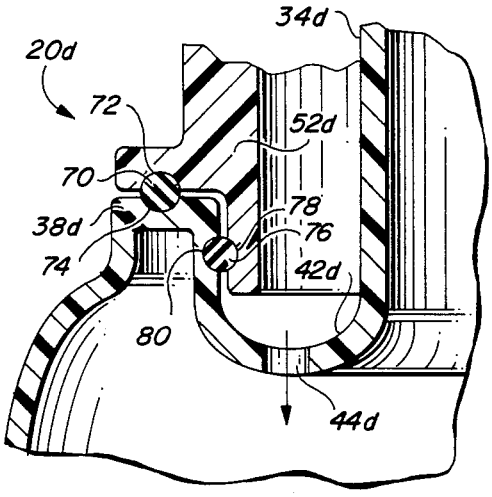
FIG. 10 is an enlarged schematic fragmentary vertical section of a portion of the cap base and platform of a fifth preferred embodiment of the assembly of the present invention; and, FIG. 11 is an enlarged schematic vertical section of the cap base and platform of a sixth preferred embodiment of the assembly of the present invention.

A third preferred embodiment of the present invention is schematically depicted in FIG. 8, a fourth such embodiment is shown in FIG. 9 and a fifth in FIG. 10. Those embodiments are substantially identical to assembly 20. Similar components bear the same numerals, but are designed, respectively, by the letters "b", "c" and "d". Thus, embodiment of FIG. 8 is designated assembly 20*b* and differs from assembly 20 only in that a pair of annular detents 62 and 64 depend from cap base 52*b* and are received in similarly shaped annular recesses 66 and 68. These substitute for the o-ring and mating recess of assembly 20 and provide similar results. Moreover, the bottom of drainage channel 42*b* is curved to facilitate liquid run-off to drainage hole 44*b*.

In FIG. 9, assembly 20*c* differs from assembly 20 only in that the bottom of channel 42*c* is V-shaped in cross-section to facilitate liquid drainage, and a single annular detent 62*c* depends from cap base 52*c* and is received in an annular recess 66*c* in place of the o-ring and recess of assembly 20. Advantages of assembly 20*c* are similar to those of assembly 20.

In FIG. 10, assembly 20*d* differs from assembly 20 only in that o-ring 70 is disposed in recesses 72 and 74 in, respectively, the bottom of cap base 52*d* and the top of platform 38*d*, while o-ring 76 is disposed in recesses 78 and 80 in, respectively, the side of base 52*d* and adjoining side of platform 38*d*. Moreover, the bottom of channel 42*d* is curved. Advantages of assembly 20*d* are similar to those of assembly 20.

FIG. 11

Figure 11:
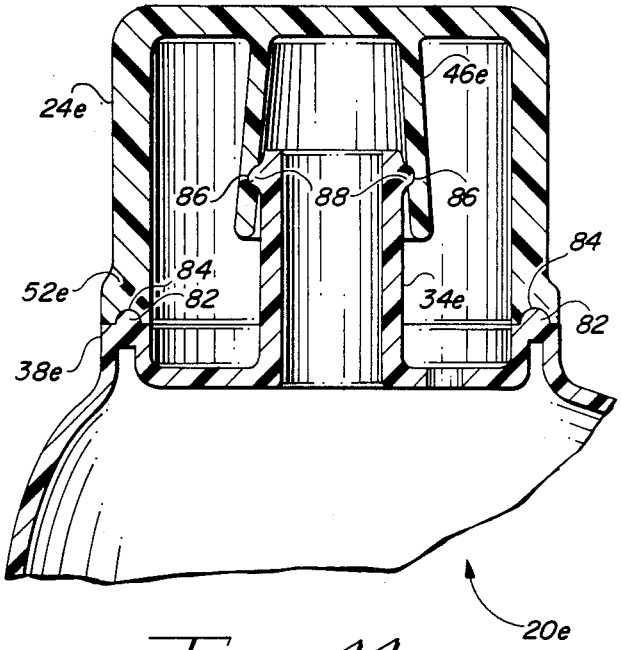

A sixth preferred embodiment of the invention is schematically depicted in FIG. 11. Thus, assembly 20*e* is shown. Components thereof similar to those of assembly 20 bear the same numerals, but are succeeded by the letter "e". Assembly 20*e* is identical to assembly 20 except that the top of platform 38*e* has an upstanding annular detent 82 received in an annular recess 84 in cap base 52*e*, and except that sleeve 46*e* is frusto-conical and flexible and resilient and has an annular recess 86 in its interior surface within which an annular detent 88 on the outer surface of spout 34*e* is receivable to releasably and sealingly secure cap 24*e* to spout 34*e*. Assembly 20*e* has properties similar to assembly 20.

Various other modifications, changes, alterations and additions can be made in the improved assembly of the present invention, its components and their parameters. All such changes, modifications, alterations and additions as are within the scope of the appended claims form part of the present invention.

What is claimed is:

1. An improved cap-containing, liquid-dispensing container assembly, said assembly comprising, in combination:

(a) a container having interconnected bottom, side and top walls defining a hollow interior storage space, said top wall having an upstanding liquid-dispensing pour spout communicating with said storage space, a raised cap base-receiving annular platform disposed peripheral of the base of said spout, and a recessed liquid drainage channel between said platform and said spout, said channel including a bottom drain hole communicating with said storage interior;

(b) a measuring cap disposed over and releasably secured to said spout by first sealing means, the base of said cap abutting said platform; and, (c) second sealing means releasably sealing said cap base to said platform.

2. The improved container assembly of claim 1 wherein said first sealing means comprises a sleeve secured to and centrally depending from the top interior of said cap peripheral of said spout, and threaded portions on the exterior of said spout and on the interior of said sleeve.

3. The improved container assembly of claim 1 wherein said first sealing means comprises a generally frusto-conical sleeve secured to and centrally depending from the top interior of said cap peripheral of said spout, and a mating detent and detent-receiving recess on the interior of said sleeve and exterior of said spout.

4. The improved container assembly of claim 3 wherein said sleeve is flexible and resilient.

5. The improved container assembly of claim 1 wherein said channel has a curved bottom within which said drain hole is located.

6. The improved container assembly of claim 1 wherein said second sealing means comprises an o-ring disposed in a recess in at least one of (a) said platform and (b) said base of said cap.

7. The improved containing assembly of claim 1 wherein said second sealing means comprises an annular projection integral with and extending from one of (a) said platform and (b) said cap base, and a mating projection-receiving recess disposed in the other of (a) said platform and (b) said cap base.

8. The improved container assembly of claim 6 wherein said o-ring is disposed in a recess in both said platform and the adjacent portion of said cap base when said cap is in place on said platform.

9. The improved container assembly of claim 6 wherein said first sealing means comprises a sleeve secured to and centrally from the top interior of said cap peripheral of said spout, and mating threaded portions on the exterior of said spout and interior of said sleeve.

* * * * *